US005143057A

United States Patent [19]

DePasquale

[11] Patent Number: 5,143,057

[45] Date of Patent: Sep. 1, 1992

[54] OVERPRESSURE DEVICE FOR MECHANICAL TREATMENT OF THE HUMAN BODY

[76] Inventor: Louis J. DePasquale, 9 Remsen Cir., Yonkers, N.Y. 10710

[21] Appl. No.: 716,071

[22] Filed: Jun. 17, 1991

Related U.S. Application Data

[63] Continuation-in-part of Ser. No. 440,514, Nov. 21, 1989, abandoned.

[51] Int. Cl.[5] ..... A61H 7/00; A63B 21/00

[52] U.S. Cl. ..... 128/61; 602/19; 482/131

[58] Field of Search ..... 128/60, 61, 63, 44, 128/78, 75, 875, 876, 57, 58; 272/116, 119, 120, 126, 127, 137, 139, 143, 109, 70 A; 224/226; 482/131; 602/19

[56] References Cited

U.S. PATENT DOCUMENTS

| | | | |
|---|---|---|---|
| 4,026,547 | 5/1977 | Silverstolpe et al. . | |
| 4,090,706 | 5/1978 | Reda . | |
| 4,318,502 | 3/1982 | Lowe et al. | 224/226 X |
| 4,428,577 | 1/1984 | Weingardt . | |
| 4,441,707 | 4/1984 | Bosch . | |
| 4,540,173 | 9/1985 | Hopkins, Jr. . | |
| 4,627,619 | 12/1986 | Rockwell et al. . | |
| 4,962,873 | 10/1990 | Schattel | 224/226 |

FOREIGN PATENT DOCUMENTS 668374 8/1963 Canada .

*Primary Examiner*—Richard J. Apley
*Assistant Examiner*—Linda C. M. Dvorak
*Attorney, Agent, or Firm*—Thomas Dowd

[57] ABSTRACT

A device for applying localized forces to portions of the human anatomy, such as the spine, to treat physical conditions and disorders requiring some degree of mechanical manipulation of therapy, comprising an outer roll of pliable material having a resiliently deformable surface for comfortably but firmly engaging a body portion of a user in a surrounding manner; a supporting member extending within the roll and of a stiffer but bendable material so as to provide support for and wrappingly press the roll against the effected body portion; and drawing members extending from the ends of the supporting member and grippable by the user for applying the required force to the supporting member to press the roll against the body portion. The drawing members may be hand grips or a belt member to tie the roll about the user's waist. Additionally, a stabilizing member may be attached between the roll and belt member to extend between the user's legs for preventing the roll from riding up too far on the user's back when pressure is being applied by pulling on the drawing members.

20 Claims, 2 Drawing Sheets

OVERPRESSURE DEVICE FOR MECHANICAL TREATMENT OF THE HUMAN BODY

CROSS-REFERENCE

This is a continuation-in-part of my co-pending application Ser. No. 07/440,514 filed on Nov. 21, 1989, now abandoned.

BACKGROUND OF THE INVENTION

The present invention relates to the field of physical therapy and more particularly to a device for applying localized forces to portions of the human anatomy, such as the spine, to treat physical conditions and disorders requiring some degree of mechanical manipulation and therapy.

The human anatomy from the standpoint of a mechanical structure is subject to many disorders of the muscular and skeletal system which can be treated or relieved by the localized application of appropriate forces. For example, spinal dysfunction is a common ailment that can result from injury, improper posture, and normal aging and stiffening of the lumbar spine, and which can produce much discomfort and pain on the part of a patient afflicted with the condition. A further spinal condition is derangement of the lumbar discs wherein one or more discs between the vertebrae are out of place and may press on pain sensitive structures causing extreme pain. Both of these conditions are a common cause of lower back pain which can be brought on or relieved by forces acting on the affected area.

To treat and relieve such conditions, various mechanical devices are available for exerting pressure in the locality of the muscles or spine to counteract the forces causing the discomforting or painful condition. For example, pillow-type cushioning rolls are known that tie about the waist of a user to support the lumbar region while the user is sitting, lying, or sleeping. Other devices are available for exerting overpressure on an involved region of the anatomy and involve the use of firmer members such as straps or like tension elements which press against the involved region and are stabilized or anchored by attachment to a bar or frame device. These available devices, however, tend to be either cumbersome in use or limited in their ability to provide the directed forces necessary to produce relief for a variety of different physical ailments.

It is accordingly an object of the present invention to provide a device, simple in construction and yet versatile in use, to apply the required localized forces for treating most mechanical problems in the human anatomy to some extent and particularly those of the spinal column. The invention is directed to a device, which, among other capabilities, can provide relief of back pain and restore mobility in treating dysfunction and derangement of the lumbar spine by the appropriate application of over-pressure in the effected spinal area.

SUMMARY OF THE INVENTION

The device of the present invention is embodied in a composite structure consisting of: an outer member of comparatively inelastic but pliable material having a resiliently deformable surface, which comfortably but firmly engages a body portion of a user in a surrounding manner; a supporting member extending substantially co-extensively within the outer member and of a bendable stiffer construction than the outer member so as to provide support for and wrappingly press the outer member against the involved body portion; and drawing members fixedly connected to and extending from the supporting member and grippable by a user to apply the required force to the supporting member to press the structure against the body portion. The drawing members may be in the form of hand grips attached to the supporting member at or near its ends and/or a belt or cincture member attached to or extending through the supporting member may be provided to tie the composite structure about the waist of a user. Additionally, a stabilizing member may be attached between a drawing member or the ends of the supporting member and the center portion of the device to extend between the user's legs and prevent the outer member from riding up too far on the user's back when overpressure is being applied by pulling on the drawing members.

DETAILED DESCRIPTION OF THE PREFERRED EMBODIMENTS

Figure 1:
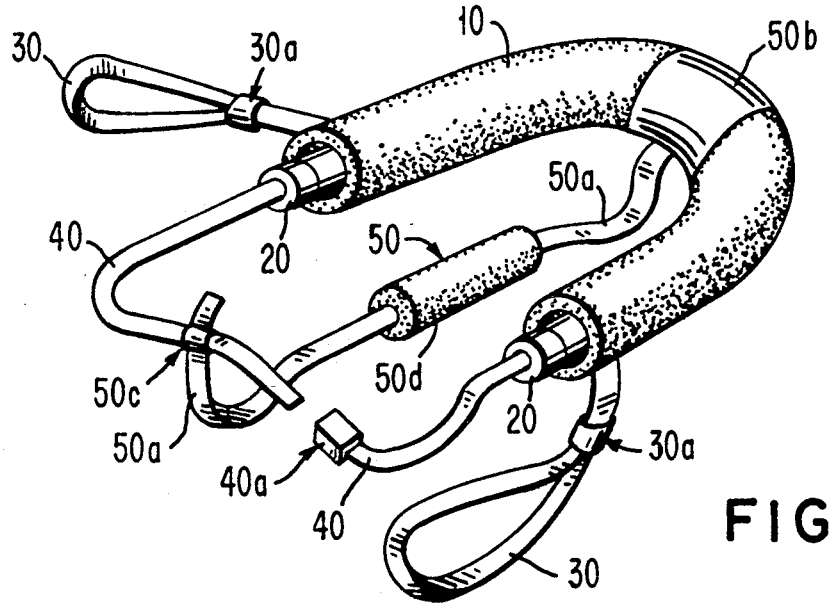
FIG. 1 is a diagrammatic view illustrating a preferred embodiment of the present invention.

One embodiment of the present invention is shown in FIG. 1. A generally tubular member or roll 10 acts as an outer member for engaging and applying pressure directly to a portion of the body of a user. Roll 10 is of a firm, comparatively anelastic, but somewhat pliable material, such as firm density polyurethane foam, having a surface which is sufficiently deformable and resilient so as to tend to conform to the contour of the body portion or area when pressed against it and regain its shape immediately upon the release of pressure Extending substantially co extensively within roll 10 is a supple supporting member 20. Member 20 is of a stiffer and firmer material than that of roll 10, such as plastic, rubberized material, or the like, that is bendable and acts as a support for the roll 10 and to exert a pressing force along the length of the roll in a manner to evenly distribute the pressing force locally applied through the roll so the body portion. The combination of the softer roll 10 or contacting the body portion and the firmer support member 20 for surroundingly or wrappingly pressing the roll to apply overpressure to the involved area provides a comfortable, localized force, appropriately distributed over the engaged body area by the conforming composite structure. This structure offers a directed, firm, conforming pressure in contrast to the cushion-like forces applied by prior art pillow-type rolls and the non-conforming, uncomfortable forces of straps or other non-resilient tension members The length of the structure will be such as to permit the comfortable surrounding of the contour of the body portion to be treated while allowing freedom to draw the structure about the body portion.

Figure 2:
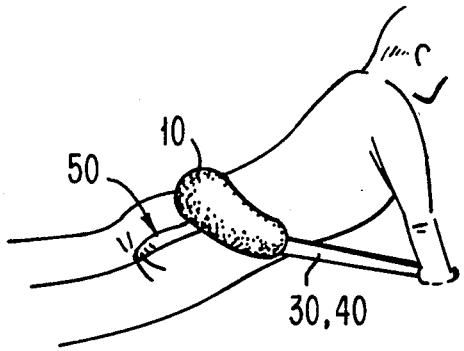
FIG. 2 and 3 show a user utilizing the invention to apply overpressure to the lumbar region.

In order to apply the roll 10 with pressure against the body area, such as the lumbar region, of a user, appropriate drawing members(30, 40) are attached to the supporting member 20. These drawing members may be in the form of straps or handles 30 adapted to be gripped by the user's hands and fixedly connected to or near each of the ends of the supporting member 20 which ends extend somewhat out of the ends of the roll 10. A suitable adjustment fitting 30*a* may be provided in each strap 30 to permit the length to be varied. As seen in FIG. 2, a user when applying overpressure to the lumbar region while reclining, grips the respective straps with each hand and draws the roll 10 to exert a transverse force on the lower back. The resulting overpressure causes the roll 10 to closely surround the lumbar area and comfortably conform to the body contour while applying an evenly-distributed pressure on the spine.

Figure 4:
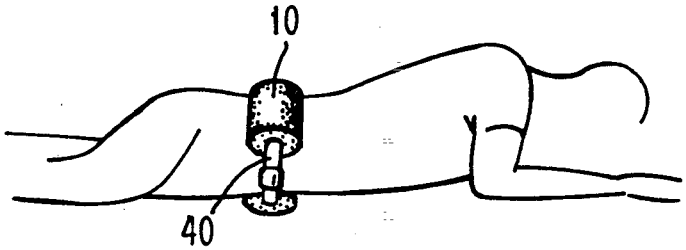
FIG. 4 illustrates the use of the invention by a user while reclining.

Additionally, or alternatively to the gripping members 30, belt or tie members 40 may be provided for applying overpressure or fastening the device around the waist of a user. In the fastened condition the device provides circumferential lumbar support to the user when sitting, or when lying down or sleeping as shown in FIG. 4. The members 40 may be the ends of a rope-like element extending within a tubular supporting member (FIG. 1) or be two tie members fixedly attached to the respective ends of the supporting member 20 (FIG. 2). As suggested, members 40 may be used in lieu of or in the same manner as the gripping members 30 to apply overpressure to the body portion being treated. A closure device 40*a* may be fitted to the end of one of the members 40 when they are used as a belt.

In addition to the suggested technique illustrated above in FIG. 2, this device possesses the versatility to produce a lateral or asymmetric overpressure to the human anatomy such as the lumbar region while the user is standing, sitting, or reclining.

Figure 3:
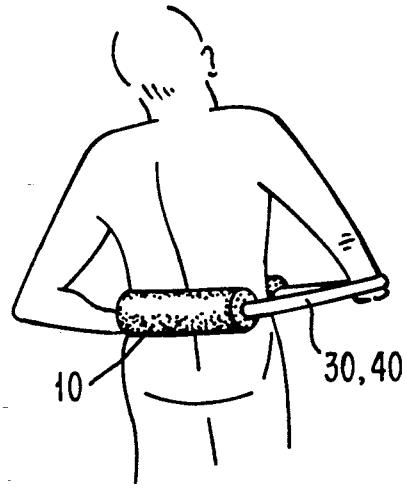

Application of a lateral, asymmetric overpressure to the lumbar region of user while standing is accomplished, as shown in FIG. 3, by the user gripping both drawing members 30 (40) in one hand while drawing the roll 10 against the side of the lumbar region creating a direct force application to one side of the lumbar region. The user stabilizes the lower lumbar region by applying a lateral and transverse overpressure while grasping the drawing members with one hand. The user simultaneously laterally displaces the upper half of the body away from the hand which is gripping the drawing members to enhance the effect of the lateral, asymmetric overpressure.

When applying overpressure to the lower back in the manner shown in FIGS. 2 or 3, the device may have a tendency to ride-up on the user's back. This superior displacement of the roll 10 may be prevented with the provision of a stabilizing strap 50. The stabilizing strap 50 may be composed of an inferior belt or tie 50*a*, which is connected between a drawing member 40 and the approximate center of the roll 10, to extend between the legs of the user as indicated in FIG. 2. Member 50 may be attached suitably to either roll 10, by a surrounding strap 50*b*, or to interior supporting member 20 by passing through an opening in roll 10. The opposite end may be attached to drawing member 40, by any suitable adjustable fitting 50*c* for such purpose, to permit the length of the tie member 50*a* to be adjusted to the size of the user. For comfort, a force distributing collar member 50*d* may be provided around tie member 50*a* to avoid the imposition of overly localized pressure between the user's legs.

Thus, this composite structure of an outer tubular roll member 10, an inner supporting member 20, and drawing members 30, 40 fixedly attached to the supporting member, constitutes a device which can be used in different orientations to apply evenly distributed, localized forces to human body portions and areas in an improved comfortable manner. The device is of simple construction offering versatility and convenience of use in treating a wide variety of ailments.

Figure 5:
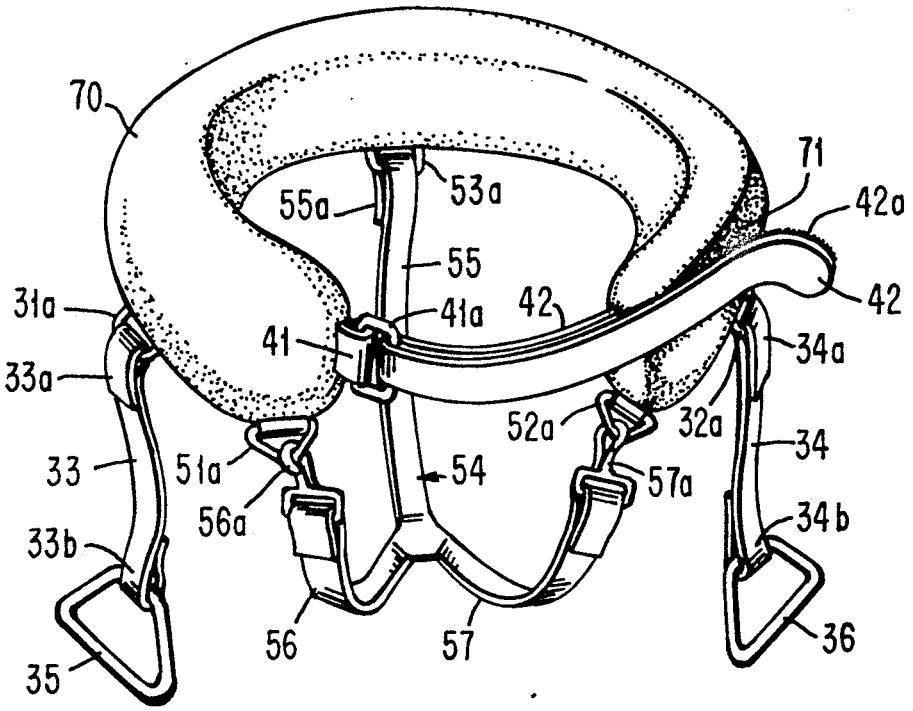
FIG. 5 is a perspective view illustrating an alternative embodiment of the present invention.
Figure 6:
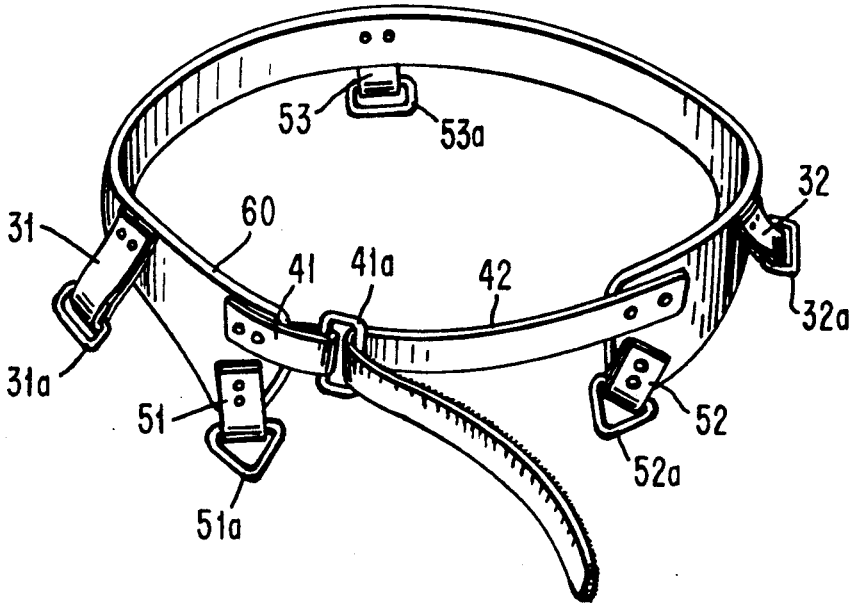
FIG. 6 is a perspective view illustrating the supporting member for the embodiment shown in FIG. 5.

An alternative embodiment is shown in FIGS. 5 and 6. As seen in FIG. 6 the supporting member 60 may be of a sheet plastic material, such as die-cut polypropylene, to which the fittings for the drawing members and stabilizing strap may be riveted. More particularly, nylon retainer straps 31 and 32 may be fixedly attached by rivets near the ends of member 60 and provided end fittings 31*a* and 32*a* for connection to drawing members 33 and 34, respectively (FIG. 5). Drawing members 33 and 34 may be connected by clip-on-and-off fasteners 33*a* and 34*a* to fittings 31*a* and 32*a* and have length-adjustment loops 33*a* and 34*a* at their opposite ends for holding handles 35 and 36.

A retainer strap 41 may be attached by rivets to one end of member 60 and have fitting 41*a* to cooperate with a nylon strap 42. Strap 42 has one end riveted to the other end of member 60 and a loose end which can pass through fitting 41*a* to act as a belt to draw the two ends of member 60 together. Additional nylon retainer straps 51, 52, and 53, may be riveted at the two ends of member 60 and to its center portion and have fittings 51*a*, 52*a*, and 53*a*, for connection to the stabilizing strap 54. As seen in FIG. 5 stabilizing strap 54 may have three sections, one 55 having a clip-on-and-off fastener 55*a* for connection to center fitting 53*a*, and the others 56 and 57 having disconnect fasteners 56*a* and 57*a* connected to fittings 51*a* and 52*a*. All three sections may be provided with length-adjustment loops as shown.

Supporting member 60, after attachment of the various riveted fittings, may be insert molded to urethane foam to form the outer member 70. A VELCRO surface 71 may be formed on one side of member 70 to cooperate with a similar surface 42*a* on the loose end of strap 42 to secure strap 42 as a belt.

Prior art devices are one dimensional, bulky, impractical in various work settings, expensive, and do not facilitate user compliance. In contrast to known devices it will be seen that the device of the invention is multidimensional, highly portable, light weight, inexpensive to manufacture and assemble and designed to facilitate user compliance. This device can be used by a patient at work, at home, or while traveling for application of dynamic symmetric or asymmetric overpressure forces to the lumbar region or other areas of the body requiring therapy. Additionally, the device can be used while reclining or sitting or standing for static force application. No known device combines the resilient supportive properties of the outer roll 10 with the firm, rigid properties of the inner supporting member 20 which along with the attached drawing members (30,40) provide the user numerous options for overpressure force application at various stages of the rehabilitation process involving the lumbar region, including derangement and dysfunction. The composite design of this device ensures durability as well as effective transmission and even distribution of appropriate forces.

Also, this device enables the user to apply lateral, asymmetric overpressure without external aids further distinguishing this device from previous ones.

Cushion-like night rolls and pillows can only be used in static situations. Strap-like devices currently available require external fixation such as a door jamb or solid frame to stabilize the strap. These devices cannot provide adequate circumferential pressures particularly in situations which require application of lateral, asymmetric forces to the lumbar region of the user.

In addition to the lumbar region, the device can be applied to other areas of the spine, such as the neck, and to muscles and joints in applications needing the mechanical forces the device is suited to apply.

The composite design of this device as previously described, provides the user with a comprehensive, versatile, multidimensional, low cost and portable method of applying appropriate overpressure to the human body.

What is claimed is:

1. A therapeutic device for applying localized forces to areas of the body, such as the spinal column, of a living user, comprising:

body engaging means for locally contacting and applying a directed force against a portion of the body of a user, said body engaging means being of a firm bendable material and having a resiliently deformable surface adapted to be substantially conforming to the contour of said body portion and applying a manipulative force thereto when pressed firmly against it;

support means, extending substantially co-extensively within said body engaging means and being of a firmer bendable material than said body engaging means, for supporting said body engaging means along its length and pressing it against said body portion;

belt means connected to said support means for tying said support means about said body portion; and drawing means, fixedly attached to said support means, for applying a bending force to said support means to wrappingly press said body engaging means along its length with a firm evenly distributed pressure against said body portion.

2. A device as in claim 1 wherein said belt means comprises means fixedly attached to the ends of said support means and said drawing means are grippable by a user, for pressing said support means against said body engaging means.

3. A device as in claim 1 further comprising means for detachably fixedly attaching said belt means to said support means.

4. A device as in claim 1 further comprising stabilizer connected to said support means, for extending between the legs of a user to resist movement of the body engaging means upwardly on the back of the user when said bending force is applied to said support means.

5. A device as in claim 4 further comprising means for adjustably connecting said stabilizer means to said support means to permit the varying of the length of said stabilizing means.

6. A device as in claim 4 wherein said stabilizer means further comprises collar means disposed to be positioned between the legs of a user for avoiding the imposition of overly localized pressure between the user's legs.

7. A device as in claim 4 further comprising means for connecting said stabilizer means to said body engaging means.

8. A device as in claim 4 further comprising means for detachably connecting said stabilizer means to said support means.

9. A device as in claim 1 wherein said body engaging means is of firm density polyurethane foam.

10. A device as in claim 1 wherein said support means is of plastic.

11. A device as in claim 1 wherein said support means is of rubberized material.

12. A device as in claim 1 wherein said drawing means comprises two straps and means for adjusting the lengths of said straps.

13. A device as in claim 1 wherein said support means is tubular and further comprising said belt means is a rope-like member extending within said support means with its ends extending from the respective ends of said support means.

14. A device for applying localized pressure to the lumbar region of a user, comprising:

a continuous member of a firm bendable material with a resiliently deformable surface and adapted to be substantially surrounding and conforming to the lumbar region of a user to apply a manipulative force to said region when pressed firmly against it;

a bendable support member extending substantially co-extensively within said continuous member and of a firmer bendable material than said continuous member, for supporting said continuous member along its length and pressing it against the lumbar region of a user;

drawing members, respectively fixedly attached to said support member and grippable by a user to produce a bending force on said support member for wrappingly pressing said continuous member along its length with a firm evenly distributed pressure about the lumbar region of the user; and belt means for trying said continuous member about the waist of a user.

15. A device as in claim 14 wherein said support member is hollow and said belt means extends through the interior of said support member.

16. A device as in claim 14 further comprising a stabilizing tie connected between at least one end of said support member and the middle of said support member and of a length to extend between the legs of a user to resist movement of the continuous member upwardly off the lumbar region of the user when said bending force is applied.

17. A device as in claim 16 further comprising a collar member on said stabilizing tie disposed to be positioned between the legs of the user to avoid the imposition of overly localized pressure between the user's legs.

18. A device as in claim 16 further comprising means for adjusting the length of said stabilizing tie.

19. A device as in claim 14 wherein said drawing members comprise two straps and further comprising means for adjusting the lengths of said straps.

20. A device as in claim 4 further comprising means for connecting said stabilizer means to said belt means.

* * * * *